United States Patent [19]

Gerhardt

[11] Patent Number: 4,551,859

[45] Date of Patent: Nov. 12, 1985

[54] CAP

[76] Inventor: Gilbert C. Gerhardt, 225 Great Rd., Maple Shade, N.J. 08052

[21] Appl. No.: 605,162

[22] Filed: Apr. 30, 1984

[51] Int. Cl.[4] ..... A42D 1/06

[52] U.S. Cl. ..... 2/172; 2/195; 2/199

[58] Field of Search ..... 2/195, 198, 197, 199, 2/200, 201, 425, 172, 209

[56] References Cited

U.S. PATENT DOCUMENTS

| | | | |
|---|---|---|---|
| 479,185 | 7/1892 | Hadden | 2/209 |
| 2,883,669 | 4/1959 | Rafowitz et al. | 2/195 X |
| 2,885,683 | 5/1959 | Lipkin | 2/197 X |
| 3,247,523 | 4/1966 | Lipkin | 2/197 |
| 3,414,906 | 12/1968 | Bonk et al. | 2/172 |
| 3,518,701 | 7/1970 | Fekete | 2/172 |

*Primary Examiner*—Louis K. Rimrodt
*Attorney, Agent, or Firm*—Paul Maleson

[57] ABSTRACT

A cap intended for cold or cool weather use, particularly useful in sports such as skiing, but not limited thereto. The cap is provided with integral ear flaps. A particular characteristic is that the ear flaps are self-stowing in the interior of the cap; that is, they tend to retract into the cap and out of the way without intevention. When in the downward operational position, the ear flaps tend to fit snugly around the ears of the wearer without the necessity of additional ties. An elongated securing of one edge of the ear flaps and the provision of a stiffener layer in the ear flaps combine to produce the spring-like lever-like action resulting in these advantages.

12 Claims, 5 Drawing Figures

CAP

BACKGROUND OF THE INVENTION

Many types of caps are known. Many caps are specifically designed for cold weather wear, and many caps are specifically intended for cold or cool weather sports, such as skiing. The present invention is an improvement in such caps. It is not limited to skiing or to sports in general, but it has particular usefulness in those areas.

The invention is particularly addressed to the provision of ear flaps integral with the cap. Prior art includes U.S. Pat. No. 1,350,869 which shows a circumferential flap which may be folded inwardly by hand; U.S. Pat. No. 2,883,669 which provides ear flaps without automatic foldability; U.S. Pat. No. 970,554 which may show flaps folded under a side rib portion; U.S. Pat. No. 837,495 which teaches a cap having a displaceable hanger portion; and U.S. Pat. No. 3,337,877 which discloses a cap with an ear flap but does not provide for automatic stowing.

SUMMARY OF THE INVENTION

This invention relates to caps particularly suitable for use in cool or cold weather. It has particular applicability to active sports and is particularly valuable to skiers, but is not so limited in its utility.

A particular characteristic of the cap is a provision of integral ear muffs which are self-stowing or self-retractable, and are also self-snug fitting against the ears of the wearer when the flaps are in a lowered or operational condition. The ear flaps are provided with an internal bendable but relatively stiff layer of material, such as buckram. An important aspect is that the portion or edge of the ear flap which is fastened to the major portion of the cap is fastened at or is restrained and held against the cap along a significant portion its length. The term "significant portion" means a portion or extent long enough so that a relatively rigid spring-like and lever-like action is obtained so that the unfastened or free portion of the ear flap tends to "line up" with the affixed or secure portion. The effect of this structure is that the ear flaps tend to spring up into the interior of the cap and lie adjacent the crown, so that the cap, if donned without manipulation, has the ear flaps automatically self-stowed within the body of the cap. Another result of this same structure is that when the ear flaps are manually swung downwardly and the cap is donned in this condition, the spring-like lever-like action tends to force the flaps snugly against the ears of the wearer without the necessity of additional ties.

The action of such a snug fit is further aided by the use of an elastic section in the headband, so that the headband is tended to be forced into a snug fit around the head of the wearer.

One way in which the above structure may be fabricated is to insert the proximal end of the ear flap downwardly between the inner and outer portions of the headband, so that the interior sweatbamd portion of the headband and the outer surface thereof tend to form a kind of socket to hold that portion of the ear flap in close adjacent parallel relationship with the headband.

An additional refinement is the provision of an inwardly facing concavity, when the ear flaps are in the lowered position, so as to produce a further snugness of fit against the ears.

The resulting cap is economical, utilitarian, attractive, easy to use, easy to store, and does not require additional ties to hold the ear flaps in place.

DESCRIPTION OF THE PREFERRED EMBODIMENT

Figure 1:
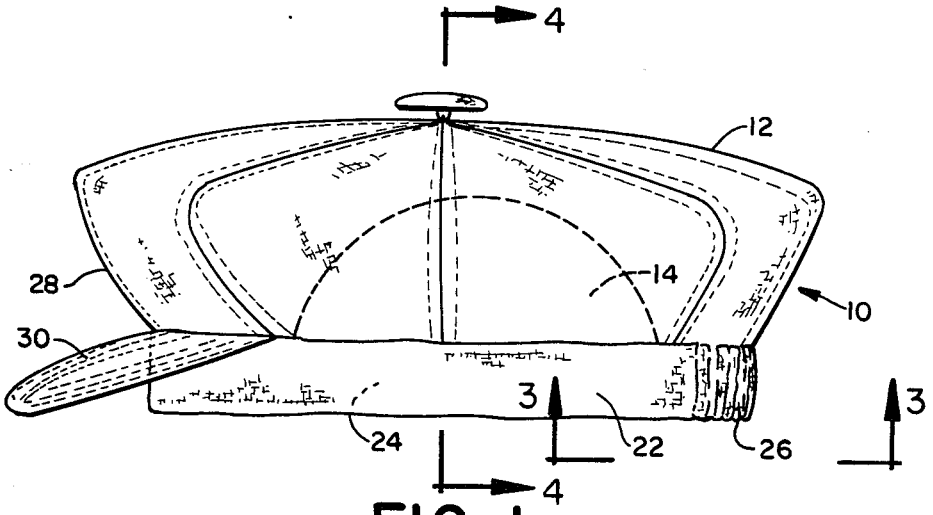
FIG. 1 is a left side elevation view of the cap, with the ear flaps retracted.

An embodiment of the cap, generally designated 10, is shown in FIG. 1. In that figure, the cap 10 is shown with self-retractable ear flaps in the retracted or up or hidden condition. The cap, generally designated 10, as shown in FIG. 1, comprises a top 12, a sweat band 24 having an outside surface 22, and a a stretching, elastic, or adjustment portion 26 at the rear thereof.

The cap additionally comprises a crown 28 and a peak or visor 30. Typically, a button is provided at the very top of the cap, but that structure is not an essential part of the invention. The peak or visor 30 is typically provided, and as a practical matter exists on every embodiment of the hat, but the peak or visor does not itself form an essential portion of the invented concept. In FIG. 1, the ear flaps, 14, are retracted upwardly into the interior of the cap 10, the position of the left side ear flap 14 is shown in dotted line.

Figure 2:
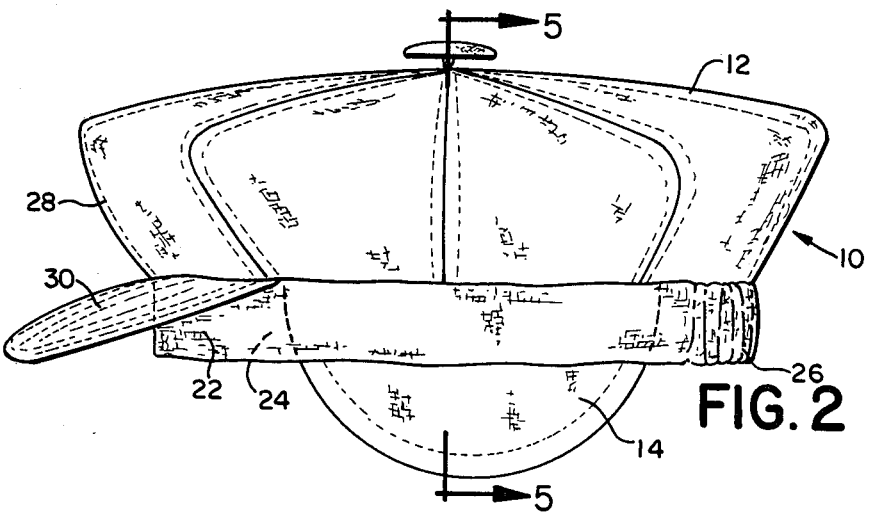
FIG. 2 is a left side elevation view of the cap with the ear flaps extended.

FIG. 2 is a left side elevation view of the cap of FIG. 1, except that in this figure, the ear flaps 14 are shown in the down or extended position. The left side 14 is visible in FIG. 2. There is of course an identical right side ear flap on the other side of the cap.

Figure 3:
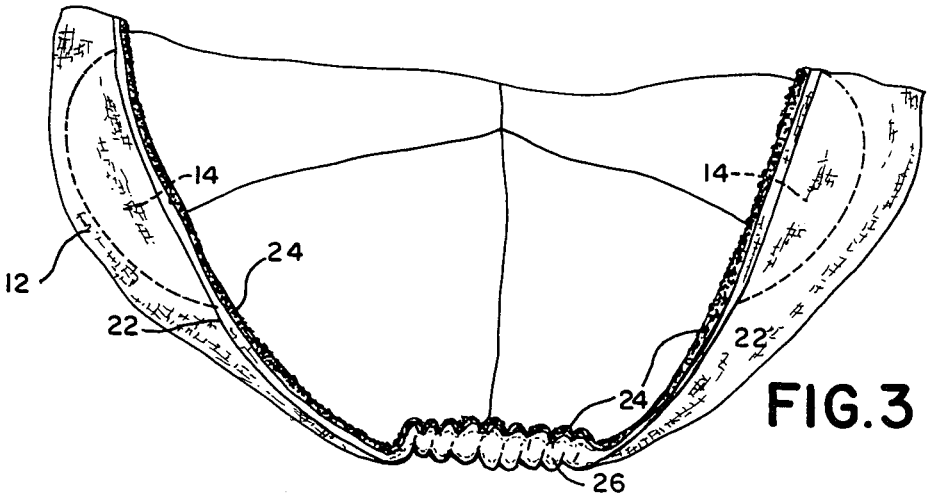
FIG. 3 is a view of the bottom of the cap, taken at line 3—3 of FIG. 1.

FIG. 3 is a view of the bottom of the cap 10, taken in the direction of line 3—3 in FIG. 1. This view is partially fragmented. It shows the structure of the cap with particular relation to the adjustment or elastic or stretch section 26. The sweat band 24 is clearly shown in this figure, in its relationship to the outer surface 22 of the sweat band. The stored or retracted locations of the ear flaps 14 are clearly shown in this figure also.

The major and outer portion of the cap 10, including the top 12, the crown 28 and the outer surface 22 of the sweat band are preferably made of any suitable tightly woven fabric, generally and preferably nylon, although the exact material is not limiting. The sweat band 24 is preferably a sewed in strip of terrycloth. The sweat band 24 and the outer surface 22 to which it is sewed together may be described as the headband of the cap. At the back of the cap, a short strip of elastic material such as synthetic rubber is affixed to the headband in any conventional way. When affixed, as by sewing at the ends, it is in a stretched or elongated condition, so that when released, it pulls the handband into a puckered condition at stretch portion 26. The effect of stretch portion 26 is to pull the back of the cap and particularly the headband at the back, into an elastic puckered condition so that there is adjustment and accomodation for a tight fit around the head of different sized wearers. Also, the headband may be expanded so that the cap may be placed on the head of the wearer, without disturbing a hair setting. The cap is held in place on the head by the action of the elastic.

Preferably, particularly when the cap is to be used in its most common environment, in cold weather, there is an inner layer of loft, which is also known as polyfill. This material is a blanket of spun fiber polyacrylic fill, and is supplied for example by Mimarc Industries, Cornwells Heights, Pa. The use of this loft material provides insulation for the cap at low cost.

Preferably also, a further and innermost layer of the cap is also provided. The innermost layer is preferably made of acetate or nylon, or any other equivalent lining material. It is preferable also to provide additional layers of loft in the headband, between the terrycloth sweatband strip and the outer surface 22.

The preferably short visor or peak 30 is preferably made of upper and lower layers of nylon and is provided inside with a layer of stiffener, such as pellon, which is distributed for example by Peltex, of Folcroft, Pa. This is a non-woven synthetic plastic material that has structural characteristics similar to starched linen.

Figure 4:
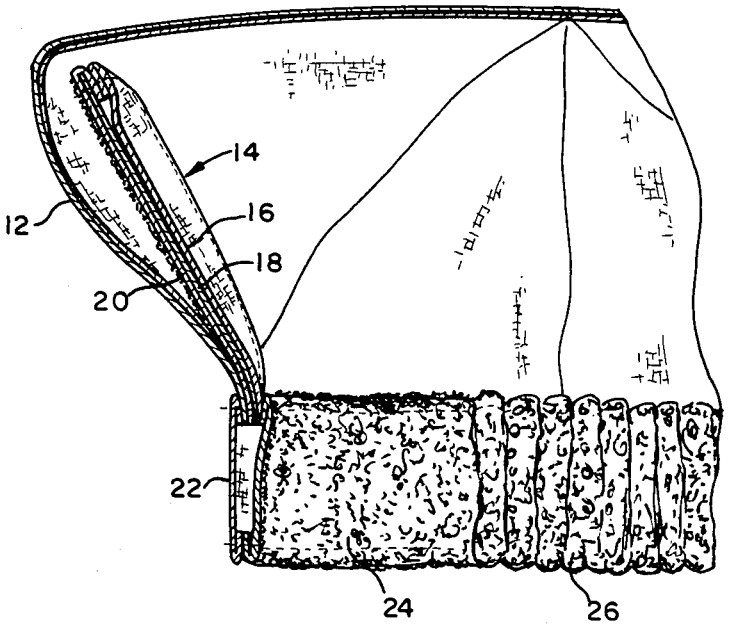
FIG. 4 is a cross-sectional view, partially fragmented, taken along line 4—4 of FIG. 1.
Figure 5:
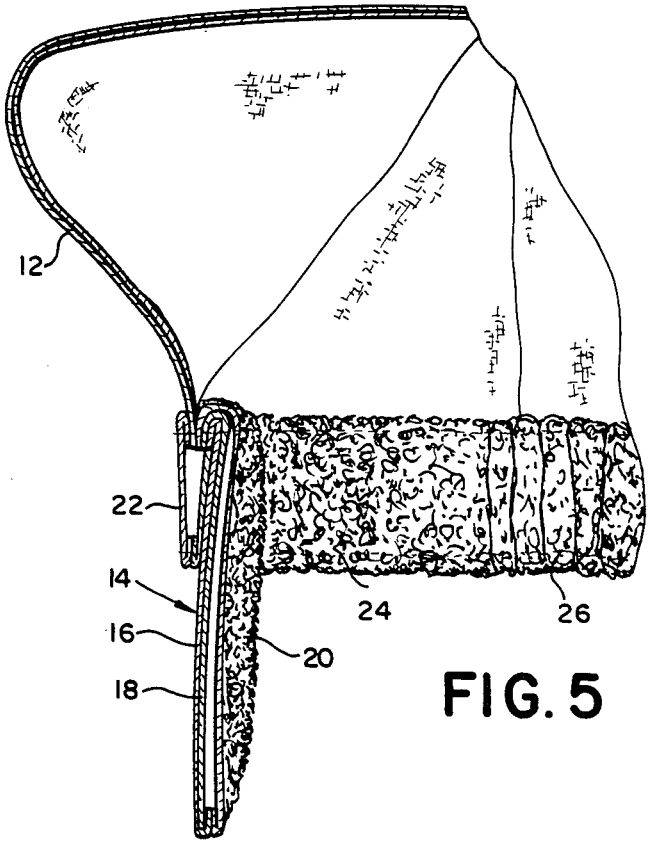
FIG. 5 is a cross-sectional view, partially fragmented, taken along line 5—5 of FIG. 2.

The most important aspect of the cap, however, relates to the structure and function of the ear flaps. FIG. 4, in a cross-section view taken along line 4—4 of FIG. 1, and being partially fragmented, clearly shows the structure of the ear flaps in the upper or retracted or hidden condition. FIG. 5, a cross-sectional view taken along line 5—5 of FIG. 2, and being partially fragmented, shows the same cap and ear flap structure with the ear flap in the down or extended or operational condition in which it protects the ear of the wearer.

The ear flap, generally designated 14 comprises an outer layer 16 of nylon or other tightly woven fabric. The term "outer layer" in this context is best defined by stating that it is the outer layer, or the layer away from the ear of the wearer, when the flap is in its operational condition as shown in FIG. 5. Preferably, the ear flap 14 is provided with an inner layer 20, preferably of terrycloth. In between these two layers is an intermediate layer 18, preferably of pellon or buckram. The characteristic of the intermediate layer is that it is relatively stiff. Preferably also, there is an additional intermediate layer of the loft material, as has been described, for insulating effect.

The mode of attachment of the ear flap to the cap is an important aspect of this invention, for reasons made apparent below. The proximal edge of the ear flap, that is, that portion of the flap closest to the body of the cap, is preferably inserted under the uppermost edge of the terrycloth sweatband, so that it extends between the terrycloth and the outer surface of the sweat band 22. A portion of the ear flap extends from the uppermost edge of the sweat band 22 to the bottom or near the bottom of the sweatband. In the preferred embodiment, there is a double line of stitching, holding the ear flap to the cap, close to the upper edge of the sweatband, and the ear flap extends past the double line and further into the interior of the terrycloth band. The exact location of the lines of stitching may vary within the spirit of the invention. Thus, there may be a line of stitching near the top of the sweatband and a line of stitching near the bottom of the sweatband. In a preferred embodiment, the terrycloth band is about 37 millimeters wide, and the ear flap extends about 20 millimeters across that width, from the top of the sweatband.

The exact dimensions and location and type of stitching may vary. However, an important aspect of the principal of operation of the invention is determined by this general structure. The provision of a significantly long expanse of the ear flap in a contrained relationship, as within the sweatband, combined with the stiffening action of the pellon or buckram stiffening intermediate layer, acts to automatically tend to keep the ear flap in the upper or retractable or hidden condition, extending vertically upwardly into the interior of the cap. This is caused by a combination of the spring-like and lever-like action of the materials, as a consequence of the attachment structure as described.

Thus, when the cap is simply held in the hand for example, no ear flaps are externally visible. They are self-retracted upwardly so that they tend to lie against the interior surface of the crown of the cap. No manipulation or handling is required to produce this effect; the natural result of the structure produces this self-stowing action. This condition is best illustrated in FIG. 4.

By hand action of the user, each ear flap may be swung downwardly against the slight spring-like resistance as has been described. After the flaps have been swung by hand to the down position, the ear flaps extend below the edge of the cap and cover the user's ears. An important function which results from this structure is that the same spring-like action which serves to self-stow or self-retract the ear flaps now serves (when in the downward position) to press the ear flaps against the ears of the user in a comfortable but snug manner. An additional contribution to this snugness is made by the tightness of the headband, sweatband structure, 22,24, which tightness is caused in turn by the tension of the elastic 26.

No separate ties or other fastenings, such as are commonly provided below the chin of the wearer, are required to hold the ear flaps in place, and the elimination of the necessity for such additional securing means is in itself an important advantage.

Thus, the same structure serves both to provide automatic self-retraction and stowing without manipulation, and also serves to provide the desirable close and snug fit against the ears of the wearer. These results are accomplished in a utilaterian, economical, and functionally distinctive cap.

A further refinement may be made in the structure of the ear flap 14, which refinement is still best illustrated in FIGS. 4 and 5. The dimensions of the terrycloth portion may be made slightly smaller than the dimensions of the nylon and stiffener portion. Such a structure, when sewn together, at its edges, tends to produce a slight bowing effect towards the terrycloth sides; that is, it tends to produce a concavity on the terrycloth side. An equivalent effect is produced by instead making the intermediate stiffening layer of a slightly larger dimension than the other elements of the ear flap. The effect of this bowing or concavity tendency is to provide a degree of conformity around the ears of the user and a somewhat snugger fit helpful in sealing out air from the ears of the user. An essential aspect of the invention remains without the bowing refinement, but the use of the bowing refinement produces the most preferred embodiment.

It is noted that an additional consequence of the structure is that the outwardly flared crown of the cap provides room for the hair settings of wearers without crushing them. A combination of this crown structure and the relatively snug headband also has the effect of producing a confined dead air space which retains heat but is less likely to cause excessive sweating than other cap structures. The cap may be crushed for easy storage, and it reverts to its desired shape when removed from a storage place, such as a pocket. The cap was originally conceived as a piece of desirable ski equipment, but it has utility in other cool or cold weather sports and has utility as a cool or cold weather cap without regard to participation in sports.

I claim:

1. A cap comprising a crown, a top, a headband having a width in the vertical direction and extending around said cap below said crown, and a pair of ear flaps each having a retracted condition and an extended condition, each ear flap being attached to and integral with said cap, each said ear flap including a relatively stiff layer, and the proximal end of each said ear flap being affixed to said cap adjacent to and parallel to said headband and making first contact with said headband at the upper edge of said width of said headband, across a substantial portion of the width of said headband, and along a substantial extent of said ear flap running from the proximal toward the distal end thereof, to cause said stiffening layer to tend to extend toward a straight line from said affixed portion to force said earflaps toward said retracted condition.

2. A cap as set forth in claim 1 wherein said headband includes an inner sweatband portion, and said extent of said ear flap is inserted between said sweatband and an outer layer of said headband, across a substantial portion of the width of said headband.

3. A cap as set forth in claim 2 wherein each of said ear flaps is affixed to said headband at least in part by at least one row of stitching.

4. A cap as set forth in claim 3 wherein each of said ear flaps is provided with an outer layer of tightly woven cloth, an inner layer of soft, tufted cloth, and an intermediate layer of relatively stiff but bendable fabric, and said intermediate layer is contrained along only part of its length in close adjacent parallel relationship with said headband, whereby the remainder of said intermediate layer tends to move toward the position of a linear extension of said retrained portion thereof.

5. A cap as set forth in claim 4 wherein said headband is provided around its circumference with an inner soft tufted sweatband, and wherein at least one portion of said headband is provided with a stretchable elastic whereby the circumference of the headband accomodates different sized wearers and fits snugly.

6. A cap as set forth in claim 5 wherein each of said ear flaps, when in the downward operational condition, have an inwardly facing concavity.

7. A cap as set forth in claim 6 wherein at least part of said cap is provided with an insulating layer.

8. A cap as set forth in claim 7 wherein each of the cap crown, top, headband, and ear flaps, are provided with an inner layer and an intermediate insulating layer.

9. A cap as set forth in claim 8 wherein said layers of said ear flaps are affixed to each other at the edges thereof, and wherein the innermost layer has dimensions slightly smaller than that of said other layers, whereby said concavity is produced.

10. A cap as set forth in claim 8 wherein each of said layers of said ear flaps are affixed at the edges thereof, and the said intermediate stiffener layer has dimensions slightly larger than said inner layer, whereby said concavity is produced.

11. A cap as set forth in claim 8 wherein said cap is provided with a visor, and the outer layer of said cap is nylon, the inner layer of said headband is terrycloth, forming a sweatband.

12. A cap as set forth in claim 11 wherein said insulating layer is loft, and wherein the top and crown of said cap have an inner liner of tightly woven cloth.

* * * * *